United States Patent [19]

Bishop

[11] 4,153,191

[45] May 8, 1979

[54] FEEDERS FOR WEB MATERIAL

[75] Inventor: Thomas D. Bishop, Birmingham, England

[73] Assignee: The Deritend Engineering Company Limited, Birmingham, England

[21] Appl. No.: 800,317

[22] Filed: May 25, 1977

[30] Foreign Application Priority Data

May 28, 1976 [GB] United Kingdom ..... 22281/76

[51] Int. Cl.[2] ..... B65H 17/22

[52] U.S. Cl. ..... 226/143; 83/313; 101/228; 226/115

[58] Field of Search ..... 226/143, 50, 115; 101/228; 83/313

[56] References Cited

U.S. PATENT DOCUMENTS

| | | | |
|---|---|---|---|
| 1,472,466 | 10/1923 | Gammeter | 226/143 |
| 2,824,736 | 2/1958 | Allen | 226/143 X |
| 3,140,633 | 7/1964 | Vincent | 226/143 X |
| 3,373,684 | 3/1968 | Fisher | 226/143 X |
| 3,756,149 | 9/1973 | Bishop | 226/143 X |

*Primary Examiner*—Bruce H. Stoner, Jr.

*Attorney, Agent, or Firm*—Marshall & Yeasting

[57] ABSTRACT

A web is reciprocated through a treatment roll pair so that a succession of treated areas is formed on the web, one of said areas being formed on each forward movement, and the reverse movements serving to enable re-positioning of the web and avoiding waste between each two said areas. Two pairs of feed rolls are provided, one pair for forward feed and one pair for reverse feed. Each feed roll pair is engageable with and releasable from the web by having separable rolls. The feed rolls are all driven from a common camshaft.

2 Claims, 6 Drawing Figures

FEEDERS FOR WEB MATERIAL

BACKGROUND OF THE INVENTION

This invention relates to feeders for web material for use with printing and more particularly die-cutting apparatus of the kind which comprises a pair of rolls of which one (called the impression roll) carries a web-treatment area in the form of, for example, a stereo or forme. When the forme, for example, extends over the whole of the periphery of the impression roll the web may be fed continuously through the nip between the rolls at the same speed as the peripheries of the rolls and a series of printed and/or cut blanks produced along the length of the web, and the small amount of waste between successive blanks formed in or from the web will be equal in length to the space between the leading and trailing edges of the forme or the like measured about the periphery of the roll.

Apparatus of this kind is required to produce blanks varying in size from small to large, and the largest which may be produced is equal to, or very slightly less than, the dimension of the periphery of the roll. With all smaller blanks, the length of web between each two blanks is waste and the amount of waste which is produced may be unacceptable. For this reason it has been the more usual practive hitherto to produce such blanks from discrete pieces of material i.e. to cut the web into blanks and feed the same individually through the apparatus, instead of feeding the web material through the apparatus, thus introducing an additional machine and an extra handling step.

It is also known, for example from British Pat. No. 1 324 169 to provide a web-treatment apparatus comprising a continuously-rotatable rotary member having a part-circumferentially extending web treatment area, a first counter pressure member co-operable with said web treatment area to effect feed of the web therebetween during a part of each revolution of the rotary member, a drive element and a second counter pressure member associated therewith, and variable drive transmission means comprising cam means rotatably fast with said rotary member and a cam follower co-operable with the cam profile of said cam means to transmit rotational drive to said drive element in such a way that, during each revolution of the rotary member, said drive element is accelerated in the same rotational sense as the rotary member immediately prior to feed of the web by said rotary member and the first counter pressure member, is decelerated in said same rotational sense immediately subsequent to termination of feed of the web by the rotary member and the first counter pressure member to arrest feed movement of the web, and is accelerated and then decelerated in the opposite rotational sense during the remainder of each revolution of said rotary member to effect reverse feed of the web, the second counter pressure member being co-operable with said drive element during such acceleration and deceleration of the latter to impart feed movement to the web and said cam means comprising a pair of cam parts which are adjustable relative to one another to vary the cam profile. Such apparatus, as described in the above British patent 1 324 169 has the advantage of enabling a series of successive treated areas to be provided along the length of the web material without waste between each two successive areas, but inevitably, the maximum length (measured along the web) of each discrete treated area is less than the periphery dimension of the treatment roll. Typically for example 112° of the angular movement of the treatment roll has been required for the minimum cycle of operation involving the acceleration and deceleration steps referred to. Effectively this has meant that the maximum length of blank which could be provided by such apparatus is equal to the arcuate length of the treatment roll over the remainder, i.e. some 250° of its periphery.

SUMMARY OF THE INVENTION

The object of the present invention is to provide an improved apparatus having the same facility as in the above British Pat. No. 1 324 169 for producing the series of treated area extending substantially consecutively along the length of the web with a minimum of or no wastage therebetween, but in which blanks equal to a large proportion of the peripheral length of the treatment roll can be produced.

According to the invention a treatment apparatus of the kind described is provided with two pairs of feed rolls each connected to a separate and independent variable drive transmission means. Hence, the two sets of feed rolls can be used for example for forward feed and reverse feed respectively, and the variable transmissions adjusted so that these operate successively and combine to produce the same effect as that achieved by the single pair of feed rolls in the prior patent, but alternatively can be adjusted so that their functioning periods overlap, to enable the total angular movement required for the complete cycle to be effectively shortened and hence enable longer blanks to be produced by given apparatus.

BRIEF DESCRIPTION OF THE DRAWINGS

FIGS. 1, 2 and 3 relate to known arrangements;

Referring now to FIG. 1 this shows a diagrammatic side elevation showing a web 10 being fed by feed rolls 12 through the nip between a pair of treatment rolls 14, 16, one of which carries a die cutting or printing (or both) forme 18.

FIG. 2 shows, also diagrammatically, the net effect likely to be produced in a typical situation with the apparatus of FIG. 1, in which the blanks B produced by the forme are each spaced along the web 10 with areas of waste or scrap W between each two blanks. Effectively the length of one blank plus one length of waste is equal to the peripheral dimension of the treatment roll 14.

FIG. 3 shows diagrammatically the arrangement in the above British Pat. No. 1 324 169. In this arrangement, shaft 20 carries roll 14 having a double (and adjustable) cam 22, 24 arranged to swing the sector gear 26 about pivot 28 so as to drive pinion 30 and hence feed roll 32. Feed roll 34 is mounted to be lifted off or dropped back onto the web as required. By suitable timing of the cams, the sector 26 can be accelerated, driven at constant speed, slowed down again, and stopped. Moreover, the sector can be driven in either direction (alternately). Hence the feed rolls 32 34 can be arranged to drive the web in reverse direction, stop it, and then feed it forwardly again whilst the roll 14 is turning through the idle part of its cycle so far as operation of the forme on the blank is concerned.

Referring now to FIG. 4, and especially by comparison of the same with FIG. 3, it will be seen that the present invention provides forward feed rolls 40, 42, and reverse feed rolls 44, 46, each associated with corresponding driven pionions 30, 30[1] and driven sectors 26, 26[1] and driven from cam arrangements 23. The cam system includes separate cam surfaces spaced apart axially along the driven shaft and corresponding to each sector, and hence enabling for example feed roll 40 to be accelerated whilst feed roll 44 is still being driven or decelerated, or vice versa, and particularly in conjunction with the lift off cooperating rolls 42, 46 which must be in the down or web contacting position for effective drive to the web to be possible, enables a greater portion of the cycle to be utilised. By arranging the apparatus for skip-feed, that is arranging for the lift-off rolls to be held up and inoperative on alternate cycles it has been found possible to enable some 300° or more to be utilised.

FIG. 5 shows details of a working arrangement in which sector 26 carries cam followers 50, 52 engaging different cam tracks 56, 58 which are adjacent to one another on the shaft, the sector being pivoted at 54. A separate cam track 60 operates cam follower 62 to displace crank 64 which operates the lift off and drop down of roll 42. The drawing shows the separate sets of all parts for the other feed roll pair, but these will be understood by the man skilled in the art after consideration of the foregoing description, and without individual identification of the parts.

Figure 1:
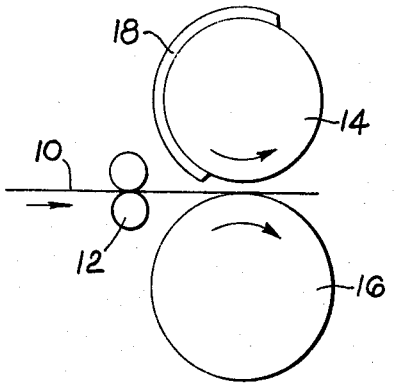
Fig. 1. (PRIOR ART)
FIG. 1 is a diagrammatic elevation showing a pair of rolls operating upon a web.
Figure 2:
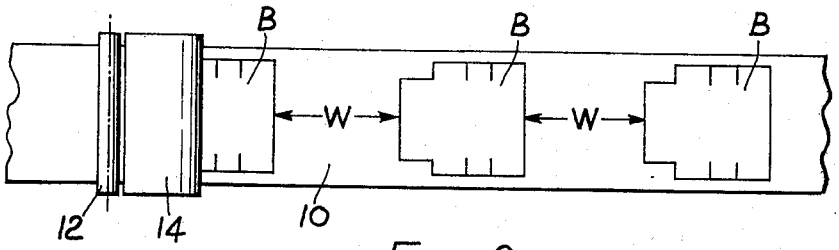
Fig. 2. (PRIOR ART)
FIG. 2 is a plan view of the same showing a series of blanks formed by the operating roll, and the waste between those blanks.
Figure 3:
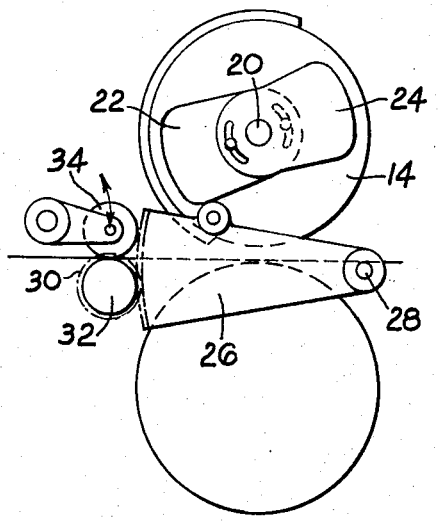
Fig. 3. (PRIOR ART)
FIG. 3 is a diagrammatic elevation of a feeder for web material.
Figure 4:
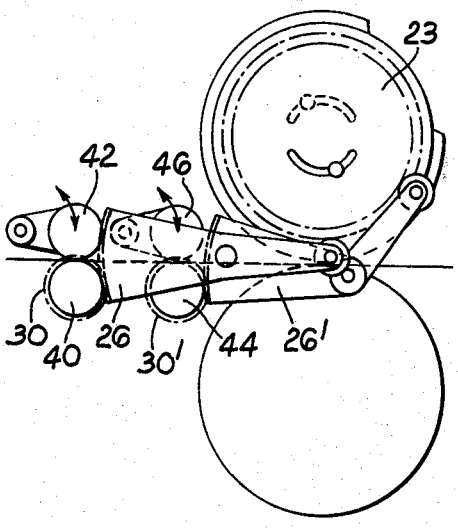
FIG. 4 is a diagrammatic elevation of apparatus according to the invention.
Figure 5:
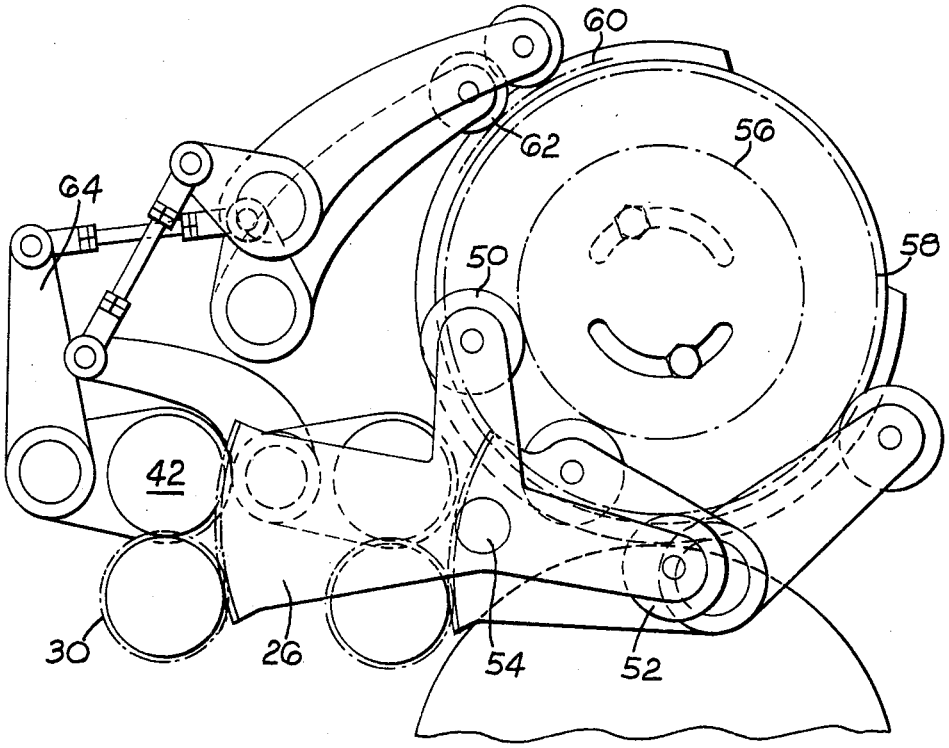
FIG. 5 shows details of a practical arrangement based on the arrangement of FIG. 4.
Figure 6:
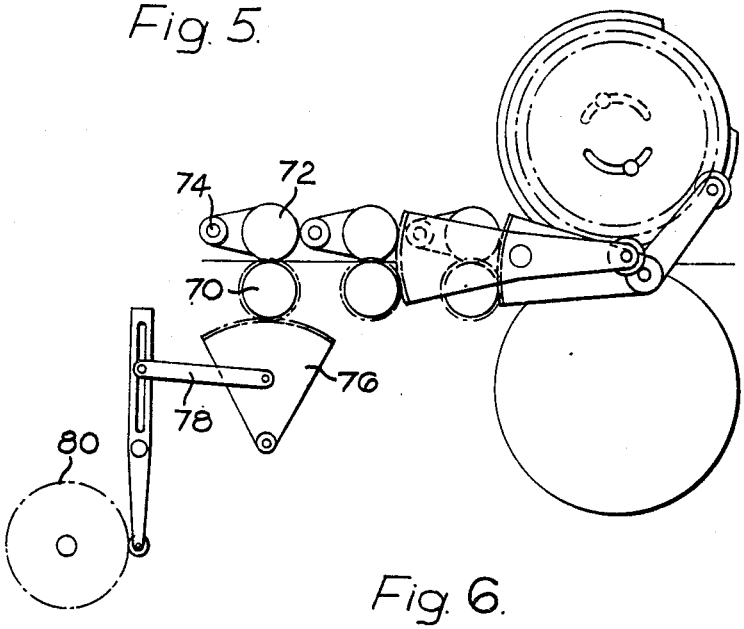
FIG. 6 is a view of a modified arrangement.

In the arrangement shown in FIG. 6, the system generally of FIG. 4 is duplicated, but an additional pair of feed rolls 70 72 is provided, the feed roll 72 being pivoted at 74 for lift off and drop down, and the feed roll 70 being fast with pinion meshed with a sector 76 arranged to be driven from a lever system 78 via a further cam 80. The purpose of this further feed roll set is to provide a additional increment of web feed which can be arranged to be operated independently of the setting of the previously described parts. This is of particular value when producing blanks with irregular ends which can be effectively nested together, that is to say to draw back the web so that the trailing end of the last treated zone is behind the nip when the next treatment operation commences.

I claim:

1. Treatment apparatus comprising a pair of treatment rolls arranged to operate on web material during a portion of each revolution of at least one of said rolls, a cam shaft carrying one of the rolls and a plurality of cam tracks, two pairs of feed rolls driven from the same cam shaft and arranged to drive the web in opposite directions, and independently adjustable variable drive transmission means so connected to the feed rolls that a synchronised area of web is delivered to the treatment rolls at the speed of the treatment rolls in each cycle of the treatment rolls, the respective transmission means for each of the pairs of feed rolls including a pivotally mounted sector for driving one of the feed rolls of the respective pair of feed rolls, a pair of cam followers carried by the sector and engaging different ones of two of said cam tracks, a pivotally mounted crank connected to lift off and drop down the other one of the feed rolls of the respective pair of feed rolls, and cam follower means driven by a third of said cam tracks for operating the crank.

2. Treatment apparatus according to claim 1 wherein the transmission means accelerate one pair of feed rolls while the other pair of feed rolls is decelerated.

* * * * *